US005233883A

United States Patent [19]

Stuhr

[11] Patent Number: 5,233,883

[45] Date of Patent: Aug. 10, 1993

[54] MECHANICAL ACTUATOR WITH SCALES INDICATING THE POSITION AT WHICH A LIMIT CONTROL ELEMENT WILL BE OPERATED

[75] Inventor: Les P. Stuhr, Corcoran, Minn.

[73] Assignee: Honeywell Inc., Minneapolis, Minn.

[21] Appl. No.: 677,077

[22] Filed: Mar. 29, 1991

[51] Int. Cl.[5] ..... G05G 01/10

[52] U.S. Cl. ..... 74/526; 116/249; 192/142 R

[58] Field of Search ..... 192/142 R, 143, 139; 116/249, 252, 284, 299; 74/526, 843, 878

[56] References Cited

U.S. PATENT DOCUMENTS

| | | | |
|---|---|---|---|
| 1,113,337 | 10/1914 | Hart | 192/142 R |
| 2,422,905 | 6/1947 | Jackson | 192/142 R |
| 2,596,330 | 5/1952 | Everard | 74/526 |
| 2,712,374 | 7/1955 | Smith et al. | 192/142 R |
| 3,213,715 | 10/1965 | Arenson | 192/142 R |
| 3,285,078 | 11/1966 | Siebold | 116/249 X |
| 3,393,657 | 7/1968 | Fukunishi | 116/249 |
| 3,454,111 | 7/1969 | Niess | 192/142 R |
| 3,879,692 | 4/1975 | Wisser et al. | 116/249 X |
| 3,902,375 | 9/1975 | Herrick et al. | 116/249 X |
| 4,018,440 | 4/1977 | Deutsch | 272/70.3 |
| 4,370,083 | 1/1983 | Burnett et al. | 411/87 |
| 4,821,593 | 4/1989 | Kobylarz | 74/475 |
| 4,934,504 | 7/1990 | Torii et al. | 192/139 |

*Primary Examiner*—Leslie A. Braun
*Assistant Examiner*—David E. Henn
*Attorney, Agent, or Firm*—Edward Schwarz

[57] ABSTRACT

An actuator of the type having a limit switch for setting the range through which the actuator's output element moves, has a first element fixed to the output element and a second element carrying an actuation element for tripping the limit switch. Tripping the limit switch during movement of the output element stops movement at that position. A detent mechanism shared by the first and second elements maintains the current position between the first and second elements until force is applied to the second element to overcome the resisting detent force and shift the second element relative to the first element. By so shifting the second element, the position of the actuator's output element is changed to thereby change the position of the output element at which the limit switch is tripped and thereby the range of motion for the output element. The invention involves scales applied to both the first and second elements to indicate their position relative to each other and thereby indicate the allowed range of motion for the output element. The scales are arranged such that the sum of the values for juxtaposed graduations equals the currently selected range of motion for the output element.

17 Claims, 2 Drawing Sheets

MECHANICAL ACTUATOR WITH SCALES INDICATING THE POSITION AT WHICH A LIMIT CONTROL ELEMENT WILL BE OPERATED

BACKGROUND OF THE INVENTION

In a variety of system applications, it is necessary to move a particular machine element to positions between and including two extreme positions in response to an external command or demand. The device which performs such an activity is generally known as an actuator, and may produce either a linear or a rotary movement. For example, electrically powered rotary actuators are used to control dampers and valves in heating, ventilating and air conditioning systems. In such an application, proper positioning of air duct dampers and fuel valves allow the condition parameters of the air in a controlled space to be held to a preselected set of values. While the following descriptive matter is directed for the most part to the angular or rotating type of actuator, the teachings can be applied with equal validity to linear actuators, and these types of actuators should be considered to be mere variations of the invention.

It is usually necessary to provide some type of limit for the range of motion allowed so as to avoid damage to the controlled device or the actuator itself, or to provide some default position if power is either removed from the actuator or set to some preset level. One means for accomplishing this limit control is to use for each direction of output element movement, a limit control element such as a switch typically mounted on the housing of the actuator, and through which power for the actuator passes. A switch actuation element which is carried by the output element and forms a feature on it, is positioned to reach and open the limit control element or switch when the output element reaches the extreme limit of its position. There are of course other means for controlling the range of motion, or stroke, for an actuator output element, but these are not the subject of this description.

Normal system applications for these actuators frequently requires that the stroke range be adjustable. For example, different types of valves and dampers may be driven by actuators of the same design, and either the design of the device driven or the specific application requires a different stroke range. An improper stroke range can cause a number of problems including inadequate operation of the controlled device, damage to the controlled device, or even potentially hazards to arise. To allow tailoring a particular design of actuator for use in a variety of specific devices and applications, they typically are designed with an adjustable stroke range for their output elements. Where the stroke range is controlled by limit switches this requires the ability to either adjust the position of each switch's switch actuation element on, or relative to, the output element, or to adjust the position of the switch relative to the output element. This invention is further limited to the former situation where the feature on the output element which comprises the switch actuation element is shifted to adjust the stroke range. There are a number of ways in which the position of switch actuation elements can be changed on the actuator's output element. One of particular interest for the invention to be described has been in use for some time on certain types of actuators. In this design, there are two switch actuation elements, each of which carry a feature which moves with the output element. These features are the parts of the switch actuation elements which actually open the switch upon the output element reaching the extreme of travel controlled by the switch. One of these features is fixed to the output element. The switch actuation element carrying the other feature is movable with respect to the first feature and the output element. There is some mechanism which holds the second switch actuation element fixed with respect to the first, but which can be disabled or overcome to allow adjustment of the second switch actuation element and its feature with respect to the first feature. A detent mechanism is preferred for this function. Such a mechanism opposes relative movement between the two features and allows an installer to move the second switch actuation element and its feature with respect to the first by overcoming the detent's force which holds the second member at a desired position relative to the first member.

In a further embodiment of these devices involving a rotary actuator, the switch actuation elements are mounted on a shaft serving as the output element and which is mounted for rotation within a housing and extending from it. The switch actuation elements are contained within the housing and are adjusted and viewed through an inspection port on a side or on the top of the housing. Normally the port is closed by fixing a cover over it to prevent contamination of the internal elements of the actuator. During installation of an actuator, the cover is removed and the movable switch actuation element is adjusted to set the range of motion for the output element. Because the port is relatively small and does not allow the installer a clear view of the features which actually operate the limit switches, it is difficult during installation to determine what is the exact angular position of the second feature with respect to the first at any point in the adjustment process. The actual angular velocity of the output element when powered is in the range of a few tenths of a degree per second, so one can see that powering the actuator to move the element to the currently selected extreme position is a tedious way to make the adjustment since several excursions of the output element to the extreme position is often necessary.

With this state of affairs, the installation of these actuators is a slow and difficult procedure. Some indication of the relative position of the features on the switch actuation elements which open these limit switches would be very useful.

BRIEF DESCRIPTION OF THE INVENTION

My solution to this problem includes an output element mounted for movement on a base or housing and supporting first and second members mounted on the output element for relative movement with respect to each other, each member carrying one of the features which when the members are properly mounted in an actuator, will operate a limit switch. The first member is fixed to the output element. For indicating the position of the feature on the first member relative to the feature on the second member structure is provided comprising on a surface on the first member a first scale formed of graduations marked with values incrementing in a first direction along the relative path of movement of the first member and having a fixed displacement from the first member's feature, and a scale-carrying surface on the second member adjacent to the scale-carrying surface of the first member and sliding in an adjacent relationship thereto as the members move relatively with respect to each other, and on the second member's scale-carrying surface a second scale similar to at least a portion of the first scale and substantially forming a mirror image of that portion of the first scale. The second scale overlaps at least a portion of the first scale and has a fixed displacement from the second member's feature. The sum of the values of adjoining graduations on the first and second members is an indication of the relative displacement of the first member's feature from the second member's feature and this is true regardless of which pair of adjoining graduations is selected for summing so long as the graduations are equally spaced and the values marking the graduations on each scale increases linearly. If the values on the graduations of each scale are selected with the proper origin, the sum of adjoining values accurately indicates the range of motion specified by the position of the second member.

One can thus see that if any of the overlapping portions of the scales are visible through the inspection port, the actual position of the first member's feature relative to the second member's feature can be determined by simple addition. By extending the length of the scales sufficiently, one can be assured that the relative position can be determined regardless of the output element position. And with the arrangement of the scales and the increase in range of motion of the output element as the scales overlap more completely, one can further realize that there will always be overlapped lengths of the fixed scale visible through an inspection port which is properly located with respect to the range of motion of the output element.

DESCRIPTION OF THE PREFERRED EMBODIMENT

Figure 1:
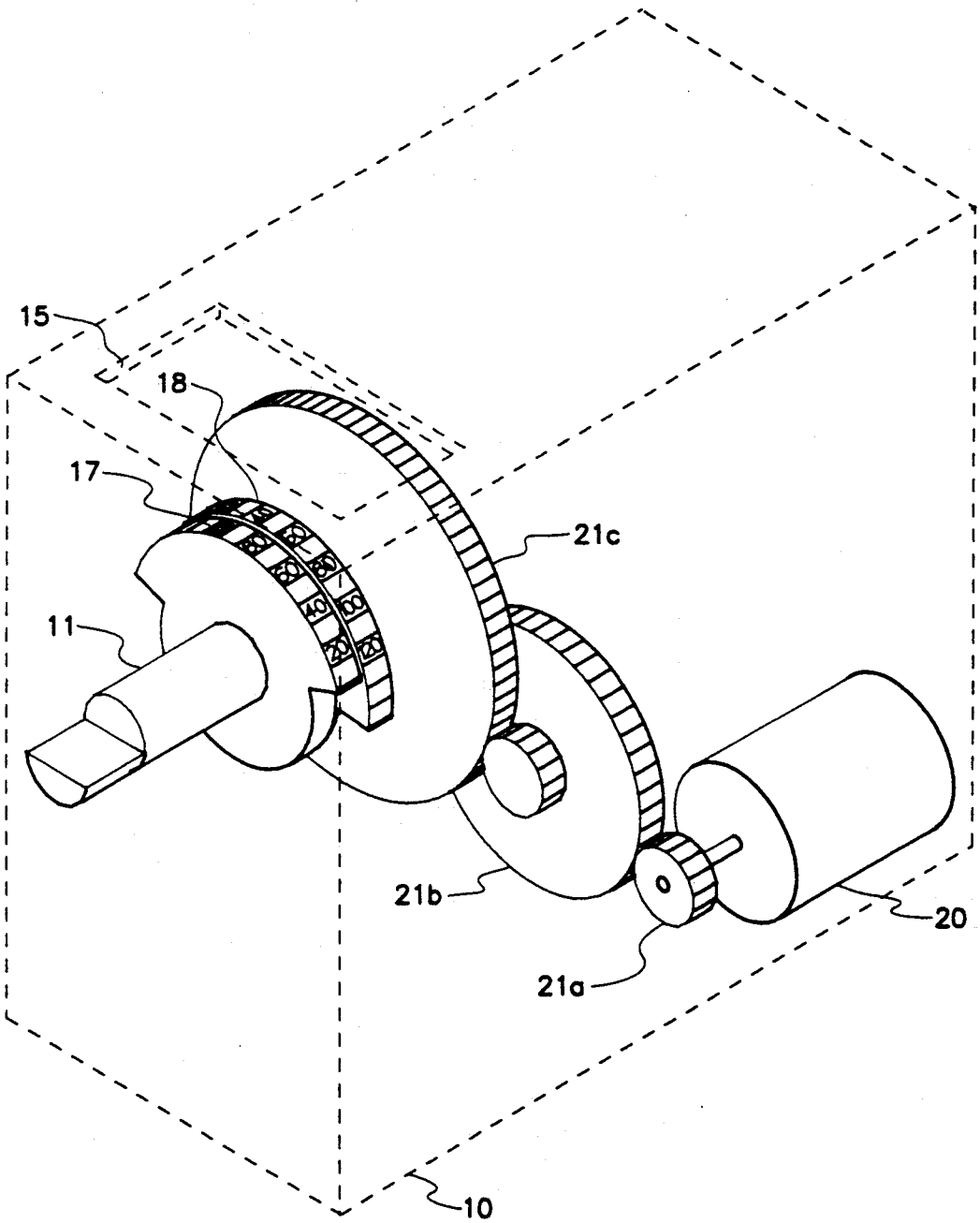
FIG. 1 is a perspective view of a typical actuator in which the invention has been installed.

FIG. 1 shows an actuator having a housing 10 in which is mounted the actuator's operating elements. An output shaft 11 serves as an output element for the actuator. A drive motor 20 is shown in outline within housing 10, and is one of the type whose direction of rotation can be changed by applying power to one or the other of two pair of power terminals. Power is applied to the output shaft 11 from motor 20 through a gear train 21 and shown with individual gears 21*a*, 21*b*, and 21*c*. Limit controls are carried on two individual disks 17 and 18 mounted on the portion of the shaft internal to housing 10 and visible through adjustment port 15. Graduations with values marking them are shown on disks 17 and 18.

Figure 2:
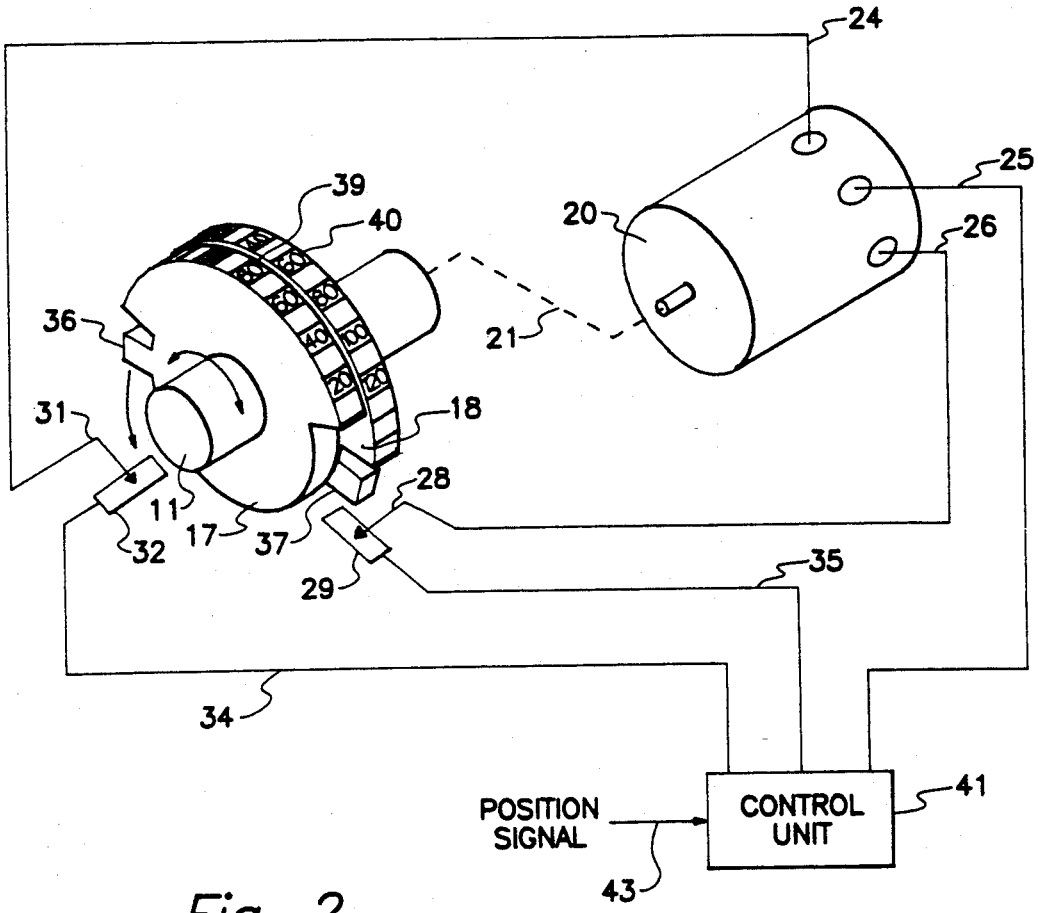
FIG. 2 is a electrical and mechanical schematic of the invention.

In the sketch shown in FIG. 2, the important elements involving the invention are shown in the required mechanical relationship with each other. Of course, these elements are all normally carried by and mounted within the housing 10 of FIG. 1, except for the portion of shaft 11 which projects. Motor 20 is shown with a common power terminal 25 and counterclockwise and clockwise power terminals 24 and 26 respectively. Motor 20 drives shaft 11 through a gear train symbolized by dashed line 21, counterclockwise when power is applied between terminals 24 and 25, and clockwise when power is applied between terminals 26 and 25. There are circular disks 17 and 18 carried on shaft 11 and rotating therewith. Disk 17 is fixed to shaft 11. Disk 18 is rotatable with respect to shaft 11 and disk 17 when a lock is released or a detent mechanism (preferred) is overcome. Disk 17 carries a feature 36 which projects from disk 17. Disk 18 also carries a feature 37 projecting from it.

Power to motor 20 for clockwise rotation of shaft 11 (as viewed in FIGS. 1 and 2) flows through a contact pair 28 and 29 forming a control element which comprises a clockwise limit switch. Power for counterclockwise rotation flows through a counterclockwise limit switch forming a control element comprising contact pair 31 and 32. Contacts 29 and 32 are movable and physically located within housing 10 adjacent shaft 11 in the path of movement of features 37 and 36 respectively to allow features 37 and 36 to mechanically operate contacts 29 and 32 to open the limit switch of which they are a part when shaft 11 has rotated to the limit position for that end of the range. Motor terminal 24 is connected to contact 31 and motor terminal 26 is connected to contact 28. A control unit 41 supplies power for counterclockwise rotation on conductor 34 to contact 32 and power for clockwise rotation on conductor 35 to contact 29. A position signal on path 43 specifies the movement desired for shaft 11.

The limits of the range of motion of shaft 11 result from the interaction of features 36 and 37 with the contacts 32 and 29 respectively. When feature 36 operates its contact 32, power to the counterclockwise terminal 24 is interrupted and rotation of shaft 11 halts. Similarly when feature 37 operates its contact 29, power to terminal 26 is interrupted and rotation of shaft 11 is stopped. The clockwise limit of rotation can be changed by repositioning disk 18 on shaft 11. If disk 18 is oriented to a more clockwise position relative to disk 17, the maximum limit on clockwise rotation is correspondingly reduced. And of course, if disk 18 is oriented to a more counterclockwise position relative to disk 17, the maximum clockwise position increases.

The structure explained above is well known. The problem which the invention solves arises when the stroke is under adjustment during installation of an actuator. It is difficult to determine the angular range of motion specified by the position of disk 18 for two reasons. The position of feature 37 may not be discernable because of the angular orientation of shaft 11 and limits on vision imposed by the relatively small size of the inspection port. And even if feature 37 can be seen, it may not be easy to determine the entire range of motion specified by the features 36 and 37.

To resolve this problem, there are provided a pair of adjacent surfaces 39 and 40 on disks 17 and 18 respectively. On surface 39 there is permanently imprinted a first scale formed of graduations marked with values incrementing in the clockwise direction. On surface 40 there is permanently imprinted a second scale formed of graduations marked with values incrementing in the counterclockwise direction. In any preferred embodiment, the values marking the graduations on each scale increase linearly and the individual graduations of each scale are each spaced from their immediate neighbors by the same predetermined incremental amount or unit. The values are chosen so that the sum of a particular value on surface 39 and the directly adjacent value on surface 40 equals the currently selected range of motion, as measured in the units separating the graduations on either of the scales. An obvious choice for the graduations is to mark them with values representing degrees. However, other values, like percentage of maximum stroke, may be more convenient in certain applications.

Figure 3:
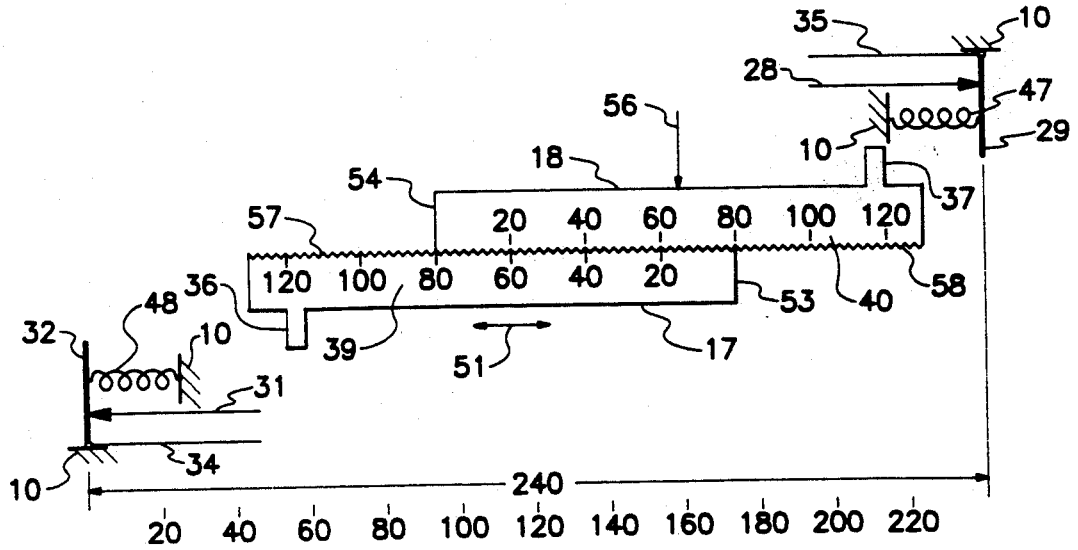
FIG. 3 is a diagrammatic representation of the operation of the invention.

In FIG. 3, there is a further representation of the operation of the invention. The aspects of FIG. 2 which are important in understanding the invention have been arranged in a linear format, preserving meanwhile the relationships between the elements and using the same reference numbers for similar elements in FIGS. 2 and 3. Thus, disk 17 and surface 39 are shown carrying a linear scale with the feature 36 at its left end. One can think of this as the scale on surface 39 being laid out flat. Similarly, disk 18 and surface 40 are shown carrying a linear scale with feature 37 it its right end. Double-ended arrow 51 indicates the directions of motion of disks 17 and 18. Contacts 29 and 32 are both shown symbolically as mounted for rotation on the housing 10. Mechanical springs 47 and 48 hold the limit switches comprising contacts 28, 29 and 31, 32 respectively in conduction unless the movable contact 29 or 32 are operated by the features 37 or 36, and the fixed ends of springs 47 and 48 are all shown symbolically as anchored on the housing 10. The position of contacts 29 and 32 places them in the path of features 37 and 36 respectively as disks 17 and 18 "rotate" clockwise and counterclockwise as shown in FIG. 3. When feature 36 reaches the upper end of contact 32 during counterclockwise movement of disk 17, contact 32 is rotated counterclockwise slightly against the force of spring 48 by feature 36 and conduction between contacts 31 and 32 is broken. As was seen from FIG. 2, this removes power available on conductor 34 from motor 20 and rotation of shaft 11 ceases. When feature 37 reaches the lower end of contact 29 during clockwise movement of disk 18, contact 29 is rotated counterclockwise slightly against the force of spring 47 by feature 37 and conduction between contacts 28 and 29 is broken. As was seen from FIG. 2, this removes power available on conductor 35 from motor 20 and rotation of shaft 11 ceases.

Disk 17 is fixed to shaft 11, as is shown in FIG. 2. Disks 17 and 18 each carry a detent pattern 57 and 58 respectively which meshes to hold the disks 17 and 18 in the current position with respect to each other under the force of a compression spring shown symbolically as arrow 56. These detents 57 and 58 can be overcome by applying sufficient force to disk 18 to cause disk 18 to slip with respect to disk 17 and shaft 11 which carries it. Shaft 11 is not shown in FIG. 3, but is to be assumed to be attached to disk 17 and supporting it for rotation. In the usual situation, the spring shown symbolically as arrow 56 is provided to press disk 18 against disk 17 sufficiently to prevent rotation of disk 18 with respect to disk 17 when feature 37 contacts and rotates contact 29.

Switch contacts 32 and 29 have been placed 240 units apart from each other in the representation of FIG. 3 as indicated by the scale on the bottom thereof. The graduations on the scales on surfaces 39 and 40 have been selected as having the same spacing as the units by which spacing between the switch contacts 29 and 32 has been measured. It is convenient to refer to the zero points 53 and 54 of the scales on surfaces 39 and 40 as being the respective scales' origins. The values marked on the scales increase linearly to the left, or counterclockwise for the fixed disk 17 and increase linearly to the right for movable disk 18. In the preferred embodiment, the total distance from the origin of the scale on disk 17 to the related feature 36 plus the total distance from the origin of the scale on disk 18 to the feature 37, equals the total spacing between the contacts 32 and 29, all measured in the units in which the scales are graduated. Such a limitation results in the sum of the values for juxtaposed graduations on the scales of disks 17 and 18 which equals the total length of the range of motion selected by the position of disk 18 relative to disk 17. Thus, by inspecting the overlapping parts of the scales carried on surfaces 39 and 40, and adding any pair of juxtaposed values from the two disks, the user can easily calculate the size of the currently selected range of motion. For the position shown for the disks 17 and 18 in FIG. 3, the range of motion is instantly available as 80 units. The units will typically be in degrees for a-rotary actuator of course. The position of the disks 17 and 18 as shown in FIG. 1 indicates a range of motion of about 135 units.

One can see that as long as any part of the overlapped sections of the scales on surfaces 39 and 40 are visible, the size of the currently selected range of motion can be easily determined. By extending the lengths of the surfaces 39 and/or 40 and the scales on them, one can assure that an overlapped portion of the scales will always be visible. Note that the origin need not be even present on either scale. It is necessary merely that the relationship between the features 36 and 37 on each scale, the correlations of values marked on the graduations with the respective origins, and the spacings between the movable contacts 29 and 32 accord with the above rules.

If in FIG. 3 disk 18 is moved to the left relative to disk 17 so that the origin of the scale on surface 40 is aligned with the graduation marked 100 on the scale of surface 39, then the range of motion for shaft 11 becomes 100 units, as can be easily confirmed by inspection. Accordingly, the length of the range of motion of shaft 11 can be changed at will, and the size of the range of motion can be instantly determined.

In the preceding discussion, the movable contact limited the extent of clockwise rotation. The reader should realize, however, that by replacing clockwise references with counterclockwise references in the discussion above, the invention may be as easily applied to an actuator whose movable contact limits the extent of counterclockwise rotation. Such a reversed relationship is considered by the inventor to be a part of his invention.

On a further point, the disclosure above has been mainly in terms of a rotary actuator. However, the same concepts are equally applicable to linear actuators. In fact, this is hinted at strongly in the discussion and explanation of FIG. 3. The reader should consider FIG. 3 as being equally applicable to rotary and linear actuators. Applicant wishes to include use of his invention on linear actuators as falling within the scope of the invention.

One should also realize that the application of this invention is not limited to electrical actuators. Hydraulic and pneumatic actuators may also use the concepts of this invention advantageously. In addition, the invention is not limited to actuators with bi-directional motors. It can just as well be applied to actuators using unidirectional prime moves (motors, etc.) upon which the adjustable limit would be applied. The actuator could then be driven in the opposite direction by other means such as a wound up spring or a weight or even the force against which the actuator is operating. A mechanical stop would be necessary to limit motion when the actuator is driven by mechanical means opposite the direction that an adjustable limit is applied.

The preceding describes a preferred embodiment of my invention; what I wish to claim by Letters Patent is:

1. In an apparatus including first and second members mounted on an output element for relative movement with respect to each other each of said members having a projecting feature structure for indicating the position of said feature on the first member relative to said feature on the second member comprising on a surface on the first member a first scale formed of graduations marked with values incrementing in a first direction along the relative path of movement of the first member and having a fixed displacement from the first member's feature, and a scale-carrying surface on the second member adjacent to the scale-carrying surface of the first member and moving in an adjacent relationship thereto as the members move relatively with respect to each other, and on the second member's scale-carrying surface a second scale similar to at least a portion of the first scale and substantially forming an inverse image of that portion of the first scale, said second scale overlapping at least a portion of the first scale and having a fixed displacement from the second member's feature, whereby said features are used to limit movement of the output element.

2. The apparatus of claim 1, wherein the values marking the graduations on each scale increase linearly.

3. The apparatus of claim 2, wherein the individual graduations of the scale are each separated from their immediate neighbors by the same predetermined incremental unit.

4. The apparatus of claim 3 wherein the values marking the graduations on the first scale correspond to the actual displacement in scale incremental units separating the respective graduations on the first scale from the first feature.

5. The apparatus of claim 4 wherein the values marking the graduations on the second scale correspond to the displacement in scale incremental units separating the respective graduations on the second scale from the second feature, whereby the sum of any value from the first scale and the adjacent value from the second scale substantially equals a predetermined number of scale incremental units less the displacement of the first feature from the second feature in terms of scale incremental units.

6. The apparatus of claim 5, including means attached to the first and second members for opposing movement of the second member with respect to the first member.

7. The apparatus of claim 6 , wherein the movement opposing means comprises a detent mechanism connecting the first to the second member and mediating the relative movement between the first and second members.

8. The apparatus of claim 5, wherein the first and second members are both mounted on a shaft for rotation relative to each other.

9. The apparatus of claim 1, wherein the first and second members are both mounted on a shaft for rotation relative to each other.

10. The apparatus of claim 1 adapted for use in an actuator for supplying power to a driven device, said actuator having a housing comprising the support in which the actuator elements and the first and second members are mounted, said housing having an inspection port through which the scale-carrying surfaces of the first and second members may be seen; an output element to which the first member is fixed and with respect to which the second member is movable, said output member projecting from the housing and movable relative to the housing through a predetermined range, said first and second members moving with the output element; a motor mechanically connected to the output element for shifting the position of the output element within the predetermined range; a first control element mounted within the housing adjacent to the output element and in the path of movement of the feature of the first member and through which passes the power to the motor when driving the output element in a first direction, said first control element mechanically interacting with the first member's feature to remove power from the motor when movement of the output element shifts the first member's feature to a preselected position relative to the first control element; and a second control element mounted within the housing adjacent to the output element and in the path of movement of the feature of the second member and through which passes the power to the motor when driving the output element in a second direction opposite to the first direction, said second control element mechanically interacting with the second member's feature to remove power from the motor when movement of the output element shifts the second member's feature to a preselected position relative to the second control element, whereby the position of the second member's feature relative to the first member's feature may be determined by visual reference through the inspection port to the scales carried on the members though at least a portion of the range of motion of the output element.

11. The apparatus of claim 10, wherein the values marking the graduations on each scale increase linearly and wherein the individual graduations of each scale are each separated from their immediate neighbors by the same predetermined incremental unit.

12. The apparatus of claim 11, wherein the scales carried by the first and second members comprise graduations marked with values thereon for which the sum of aligned graduation values on the first and second scales provide a value indicative of the range of motion of the output element between the output element positions where the first and second member's features mechanically interact with the first and second control elements respectively to remove power from the motor.

13. The apparatus of claim 10, wherein the scales carried by the first and second members comprise graduations marked with values thereon for which the sum of aligned graduation values on the first and second scales provide a value equal to the range of motion of the output element between the output element positions where the first and second member's features mechanically interact with the first and second control elements respectively to remove power from the motor.

14. The apparatus of claim 11, wherein the first and second members include a detent mechanism connecting the first to the second member and opposing the relative movement between the first and second members.

15. The apparatus of claim 11, wherein each scale has an origin at its zero unit point, and wherein the spacing between the feature on the first member and the origin of the scale thereon, plus the spacing between the feature on the second member and the origin of the scale thereon, all measured in the scales' units, equals the spacing between the control elements measured in the scales' units.

16. The apparatus of claim 1, wherein the first member is fixed on the support, and including means for holding the first and second members in a fixed position with respect to each other with movement of the support.

17. The apparatus of claim 10, wherein the first member is fixed on the output element, and including means for holding the first and second members in a fixed position with respect to each other with movement of the output element.

* * * * *